US005782283A

United States Patent [19]

Kendall

[11] Patent Number: 5,782,283

[45] Date of Patent: Jul. 21, 1998

[54] GARAGE DOOR CONSTRUCTION

[75] Inventor: William F. Kendall, Oregon, Ill.

[73] Assignee: Raynor Garage Doors, Dixon, Ill.

[21] Appl. No.: 832,434

[22] Filed: Apr. 3, 1997

[51] Int. Cl.[6] ..... E05D 15/10

[52] U.S. Cl. ..... 160/229.1; 160/201

[58] Field of Search ..... 160/201, 229.1, 160/232, 236, 40, 207

[56] References Cited

U.S. PATENT DOCUMENTS

| | | | |
|---|---|---|---|
| 1,530,762 | 3/1925 | Dautrick . | |
| 1,621,669 | 3/1927 | Johnson . | |
| 1,626,844 | 5/1927 | Kuhn . | |
| 1,724,995 | 8/1929 | Dautrick . | |
| 1,750,042 | 3/1930 | Hoover . | |
| 1,827,433 | 10/1931 | Kendall . | |
| 1,888,162 | 11/1932 | Eklund . | |
| 1,990,870 | 2/1935 | Kelly . | |
| 1,994,142 | 3/1935 | Madsen . | |
| 1,995,644 | 4/1935 | Lowe et al. . | |
| 2,017,012 | 10/1935 | Morgan . | |
| 2,059,833 | 11/1936 | Winn, Jr. . | |
| 2,093,019 | 9/1937 | Norberg . | |
| 2,099,191 | 11/1937 | Blodgett . | |
| 2,134,397 | 10/1938 | Clark . | |
| 2,166,746 | 7/1939 | Bartel . | |
| 2,557,716 | 6/1951 | Allee . | |
| 2,641,792 | 6/1953 | Peeler . | |
| 2,681,480 | 6/1954 | Dixon, Sr. . | |
| 2,694,234 | 11/1954 | Roby et al. . | |
| 2,817,875 | 12/1957 | Harris et al. . | |
| 2,852,840 | 9/1958 | Harvey . | |
| 2,871,932 | 2/1959 | Stroup . | |
| 2,910,741 | 11/1959 | Dettman . | |
| 2,952,313 | 9/1960 | Stroup . | |
| 3,000,048 | 9/1961 | Harsch | 160/229.1 X |
| 3,013,410 | 9/1961 | Dobbins . | |
| 3,104,699 | 9/1963 | Wof et al. | 160/201 X |
| 3,160,200 | 12/1964 | McKee et al. . | |
| 3,165,143 | 1/1965 | Jackwig . | |
| 3,198,242 | 8/1965 | Crosswell . | |
| 3,302,690 | 2/1967 | Hurd . | |
| 3,319,697 | 5/1967 | Krohn . | |
| 3,322,586 | 5/1967 | Hasenwinkle et al. . | |
| 3,347,305 | 10/1967 | Urbanick . | |
| 3,359,594 | 12/1967 | Pastoor . | |
| 3,566,448 | 3/1971 | Ernst . | |
| 3,608,613 | 9/1971 | Halliwell | 160/201 X |
| 3,635,277 | 1/1972 | Bahnsen . | |

(List continued on next page.)

FOREIGN PATENT DOCUMENTS

| | | |
|---|---|---|
| 0438046 | 10/1993 | European Pat. Off. . |
| 0370324 | 3/1994 | European Pat. Off. . |
| 0370376 | 7/1994 | European Pat. Off. . |
| 0612910 | 8/1994 | European Pat. Off. . |
| 3814275 | 2/1993 | Germany . |
| 3922981 | 2/1993 | Germany . |
| 9206018.8 | 7/1993 | Germany . |
| 3922995 | 9/1993 | Germany . |
| 4227311 | 2/1994 | Germany . |
| 9406615.9 | 9/1994 | Germany . |
| 9309325 | 5/1993 | WIPO . |

*Primary Examiner*—David M. Purol
*Attorney, Agent, or Firm*—Banner & Witcoff, Ltd

[57] ABSTRACT

A pinch-proof garage door for protecting human fingers from being pinched is disclosed. The garage door includes a plurality of horizontally-aligned garage door panels. Each garage door panel has a top male portion and a bottom female portion. Top male and bottom female portions of adjacent garage door panels cooperate with each other in such a manner so as to minimize a gap therebetween, thereby protecting human fingers from being pinched by both the inside and the outside of the garage door. Each garage door panel is securely fastened to a structural member which supports the weight of the panel. Adjacent structural members are vertically aligned with one another and are coupled together by a hinge pin and hinge leaf. Each structural member cooperates with an adjacent hinge leaf so as to prevent human fingers from being pinched by the inside of the garage door.

7 Claims, 11 Drawing Sheets

U.S. PATENT DOCUMENTS

| | | | |
|---|---|---|---|
| 3,648,755 | 3/1972 | Thiele . | |
| 3,740,916 | 6/1973 | Kenaga | 160/201 X |
| 3,869,269 | 3/1975 | Knapp . | |
| 3,891,021 | 6/1975 | Geoffrey | 160/201 X |
| 3,893,269 | 7/1975 | Nelsson et al. . | |
| 3,934,635 | 1/1976 | Kin . | |
| 3,941,180 | 3/1976 | Thill . | |
| 4,040,142 | 8/1977 | Ippolito . | |
| 4,151,031 | 4/1979 | Goad et al. . | |
| 4,238,544 | 12/1980 | Mullet . | |
| 4,269,253 | 5/1981 | Ziegler . | |
| 4,284,118 | 8/1981 | Ceron . | |
| 4,339,487 | 7/1982 | Mullet . | |
| 4,348,164 | 9/1982 | Fuji et al. . | |
| 4,387,760 | 6/1983 | Greschbach . | |
| 4,472,910 | 9/1984 | Iha . | |
| 4,667,724 | 5/1987 | Dragone . | |
| 4,685,266 | 8/1987 | Mullet . | |
| 4,878,267 | 11/1989 | Roach et al. . | |
| 4,893,666 | 1/1990 | Hormann . | |
| 4,989,660 | 2/1991 | Wagner . | |
| 5,001,862 | 3/1991 | Albenda . | |
| 5,002,114 | 3/1991 | Hormann . | |
| 5,036,899 | 8/1991 | Mullet . | |
| 5,043,128 | 8/1991 | Umeda . | |
| 5,103,890 | 4/1992 | Cloutier . | |
| 5,170,832 | 12/1992 | Waner . | |

14
27A
16
21
25
12
3A
18
20
23
2A.
22
60
24
29
27
46
54
57
50
53
26
36
44
52
48
38
39
40
34
51
28
32
30
55
70

FIG.4
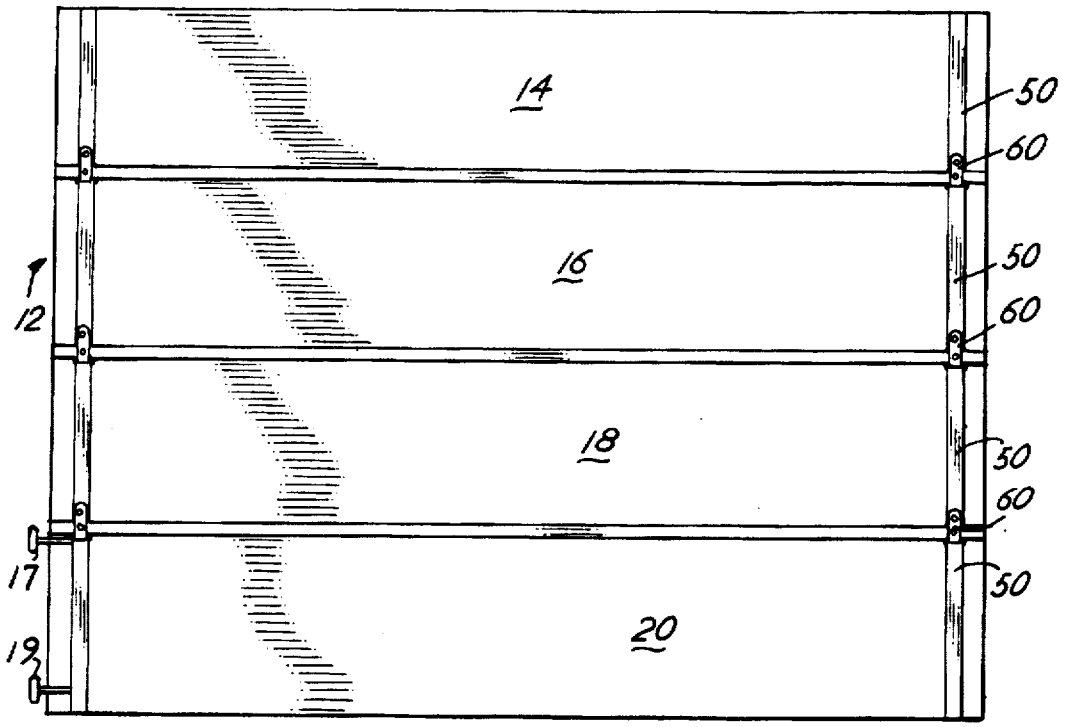
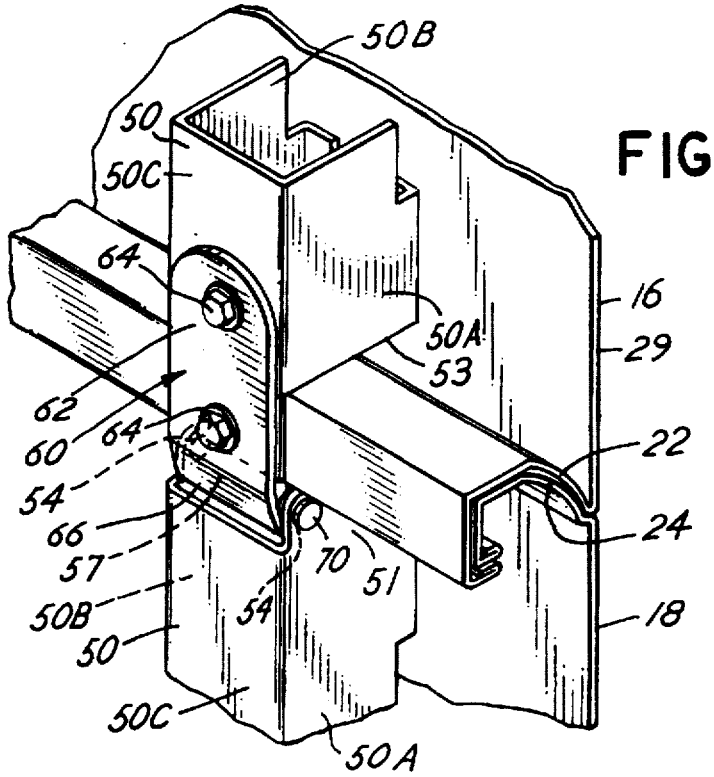
FIG.5

GARAGE DOOR CONSTRUCTION

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to the field of sectioned, overhead garage doors, and more particularly to sectioned, overhead garage doors which eliminate gaps between adjacent hingedly, connected panels forming the door during the full range of articulation of the panels relative to one another, thereby preventing insertion of a finger or finger-shaped object in the junction between panels.

BACKGROUND OF THE INVENTION

Overhead garage doors are commonly constructed from a series of horizontal sections or panels hingedly connected about horizontal axes. The sides of each panel forming the door are typically mounted on a suitable track assembly for movement between a vertical position closing the garage opening, and a horizontal position allowing access to the garage interior. The hinged panels articulate relative to one another about horizontal hinge axes of panel connection to facilitate negotiation of the orientation change between a vertical, closed position and a horizontal, open position. In moving between the vertical and horizontal positions, sizable angular gaps may be formed and then closed between facing portions of horizontal edges of adjacent panels. The formation and closure of such gaps is potentially hazardous. For example, injury may result if a finger is captured in the gap when the door is being closed. Furthermore, the gap may allow entry of rain, snow, dirt, and the like, which might impede operation of the door and obstruct the hinge mechanism. In the wintertime, the gap might permit ice formation between adjacent panels thus further impeding operation of the garage door.

Therefore, it is an object of the present invention to provide a sectional garage door with a plurality of hingedly connected, horizontal panels and means to prevent insertion of human fingers into gaps formed between the front of hingedly connected panels.

It is another object of the present invention to provide a sectional garage door with a plurality of hingedly connected panels and means to prevent insertion of human fingers into gaps formed between the rear of hingedly connected panels.

It is a further object of the present invention to provide a sectional garage door with a plurality of hingedly connected panels and means to prevent insertion of human fingers between a hinge leaf and a structural member supporting the weight of a hingedly connected panel.

Still another object of the present invention to provide a sectional garage door with a plurality of hingedly connected panels and means to prevent entry of foreign matter at the panel joints during opening and closure of the door.

A further object of the invention is to provide a sectioned garage door comprised of multiple horizontal panels connected by hinges wherein the horizontal edges of adjacent panels do not gap regardless of the orientation of the adjacent panels.

Another object of the invention is to provide a sectioned garage door comprised of multiple horizontal panels wherein the panels may be constructed with a metal facing with reinforcing ribs on the back side of the facing or as a sandwich composite of materials wherein the horizontal edges of adjacent panels do not form a gap as panel orientations change.

These and other objects, advantages and features of the invention will be set forth in the detailed description which follows.

SUMMARY OF THE INVENTION

The foregoing objects of the present invention, among others, are achieved in a pinch-proof garage door comprised of multiple horizontal panels connected by hinges along abutting horizontal edges. The garage door includes at least a first, horizontal garage door panel with a bottom female portion, and a second, horizontal garage door panel with an abutting top male portion. The bottom female portion and the top male portion are shaped to move through a full range of articulation, without interference, without forming a gap to thereby prevent human fingers from being inserted and pinched between the articulating panels. Further, the panels each may include vertical structural or reinforcing ribs integrated with the hinge constructions. Thus, a first structural rib member may be securely fastened to and reinforce the first or upper garage door panel. Similarly, a second structural rib member may be securely fastened to the second or lower garage door panel. The separate structural rib members will be vertically aligned and one of them may be connected by a hinge construction to the other.

In another embodiment, the second structural rib member is vertically aligned with the first structural rib member, is securely fastened to the second garage door panel, and has two opposed horizontally-aligned holes disposed in the sides thereof A hinge leaf attached to the first structural rib member and includes a substantially cylindrical hole aligned with the two opposed horizontally-aligned holes of the second structural rib member. The hinge leaf is connected to the second structural rib member by a hinge pin which operatively couples the second structural rib member to both the hinge leaf and the first structural rib member. The hinge pin extends through not only the two opposed horizontally-aligned holes of the second structural rib member, but also the substantially cylindrical hole of the hinge leaf. Thus, the first garage door panel and the second garage door panel pivot relative to one another about the hinge pin as the garage door transitions from a closed to an open state.

In another embodiment, the horizontal panels are fabricated in a sandwich construction with plastic foam retained as a core by a skin of metal. Hinge elements are then affixed to the backside of separate, adjacent horizontal panels.

In all embodiments, the opposed horizontal male and female edges of the adjacent, horizontal panels are configured with overlapping edges which in profile have an arcuate shape extending from the front panel to the back panel and then forward toward the front panel adjacent the hinge pin. This enables opening or articulation of the panels with a minimum gap between the edges at both the front and back of the panels.

These as well as other novel advantages, details, embodiments, features and objects of the present invention will be apparent to those skilled in the art from the following detailed description of the invention, the attached claims and accompanying drawings, listed hereinbelow, which are useful in explaining the invention.

BRIEF DESCRIPTION OF DRAWING

In the text which follows and in the drawings, wherein similar reference numerals denote similar elements throughout the several views thereof, the present invention is explained with reference to illustrative embodiments, in which:

FIG. 4 is a rear elevation of the garage door in a closed position, and depicts the inside surface as well as horizontal orientation of adjacent garage door panels;

FIG. 5 is an enlarged isometric view of the hinge assembly connecting adjacent garage door panels in the closed position;

DETAILED DESCRIPTION OF THE PREFERRED EMBODIMENTS

For a better understanding of the present invention, reference may be had to the following detailed description taken in conjunction with the appended claims and accompanying drawings. Briefly, the present invention prevents human fingers or similar items having a diameter in the range of 3 to 5 mm from being inserted into gaps between: (a) the front of horizontally adjacent and hinged garage door panels, (b) the back of horizontally adjacent and hinged garage door panels, and (c) hinge leaves and adjacent structural support members of horizontally adjacent panels. Accordingly, the garage door of the present invention prevents human fingers from being pinched during operation of the door.

FIGS. 1 through 5 illustrate a first embodiment. FIGS. 6 through 9A illustrate a second embodiment, and FIGS. 10 through 13 illustrate a third embodiment.

Figure 1:
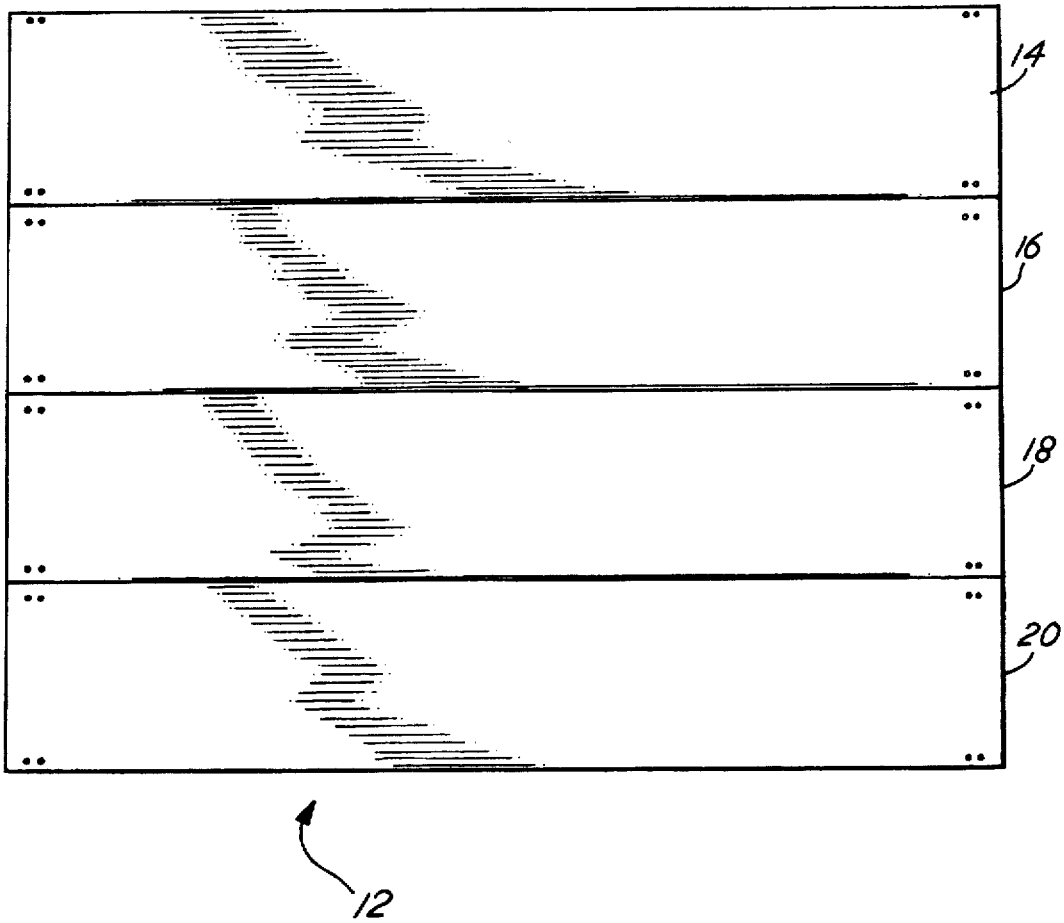
FIG. 1 is a front elevation of the outer surface of a closed garage door constructed in accordance with the present invention, and depicts the horizontal orientation of adjacent garage door panels.
Figures 2, 2A, 3, 3A, 3B:
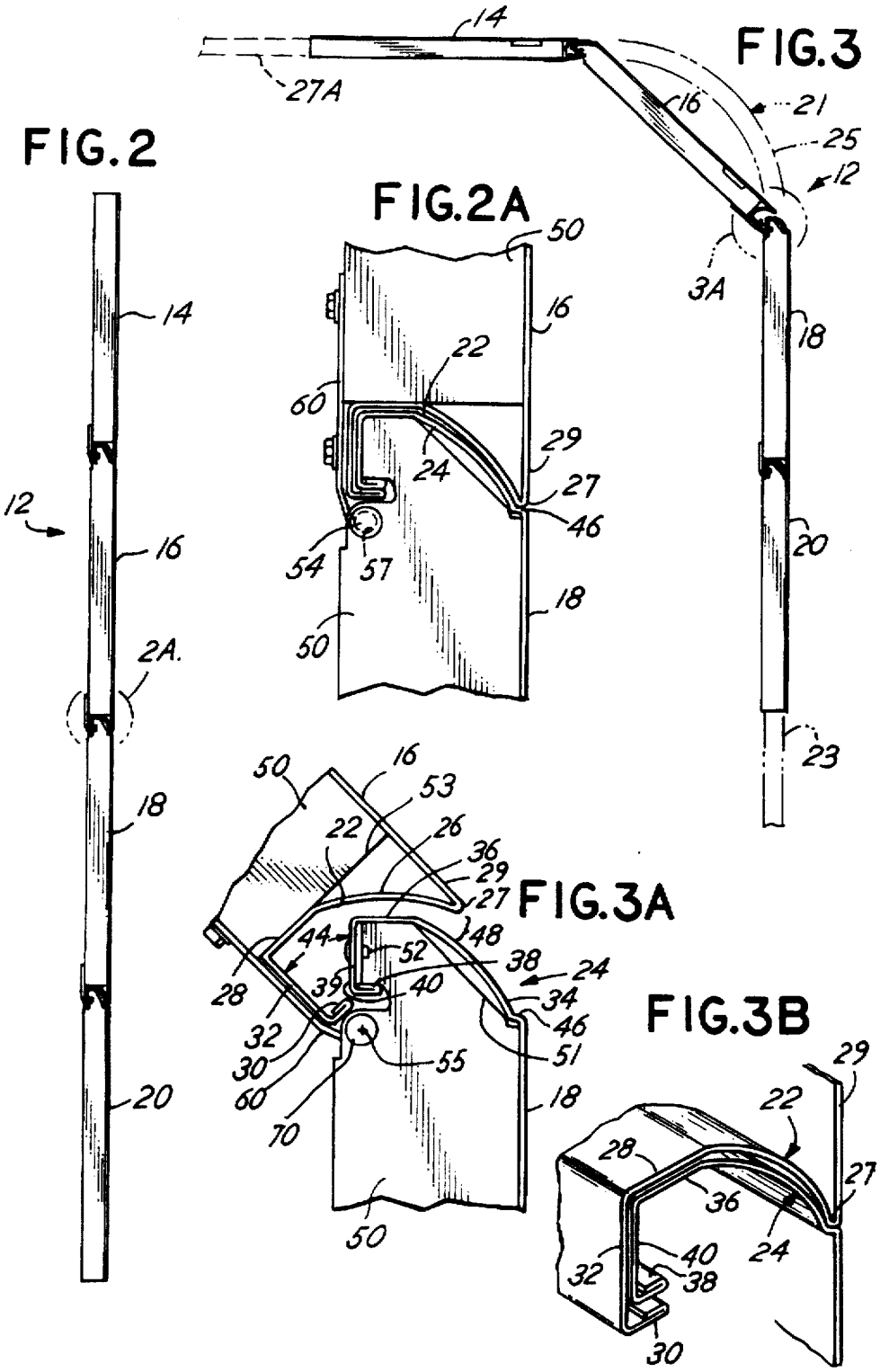
FIG.2 is a side elevation of the garage door, and more particularly of adjacent garage door panels in a closed position.
FIG. 2A is an enlarged view of the horizontal engagement of adjacent garage door panels.
FIG. 3 is a side elevation of the garage door in a half-open position, with one garage door panel horizontally disposed, one garage door panel in an angled position, and two garage door panels vertically aligned.
FIG. 3A is an enlarged view of the engagement of adjacent garage door panels, when one panel is in a half-open position.
FIG. 3B is an isometric view of the section joint and profile of adjacent horizontal door panels along the horizontal edge thereof.

Referring to FIG. 1, in a first preferred embodiment of the present invention, a garage door 12 includes a plurality of horizontally oriented, garage door panels 14, 16, 18,20. The garage door panels 14, 16, 18, 20, are generally rectangular and may be made out of aluminum, steel, stainless steel, or any other suitable garage door material. They are formed with a thin metal skin as shown in FIG. 2. The adjacent panels are connected by hinges at their horizontally adjacent edges. In particular, the hinge connection provides for articulation about an axis on or adjacent the back side of the panels forming the garage door. That is, garage door panels typically have a finite thickness of a few inches. The doors are typically fabricated from sheet metal, with or without a foam backing. The panels may include reinforcing ribs or the panels may have a foam core construction.

The thickness of the panels results in horizontal edges which may produce pinch points if, for example, the edges are flat, planar and transverse to the front and back side of the panels. Prior art patents suggest modification of the front and back edges to reduce pinch points, e.g. U.S. Pat. No. 5,002,114 and U.S. Pat. No. 3,941,180. However, the prior art patents and constructions do not necessarily eliminate all pinch points, particularly those on the back side of the door formed by the panels. Thus, the panels of the first embodiment are typical in that the panels are hinged along their back side and the panels define or have a thickness.

Referring to FIG. 2, the garage door panels 14, 16, 18, 20 when in a closed state, are in the same vertical plane and define a relatively flat outer surface. As depicted in the side sectional view of FIG. 3, the panels 14, 16, 18, 20 are hinged together along the inside or back surface of their adjacent horizontal edges. The sides of each panel include projecting rollers (e.g. rollers 17, 19, FIG. 4) which ride in a track (21 in FIG. 3) on each side of a garage door opening. The track has a vertical run 23 along the door opening connected by an arcuate section 25 to an overhead horizontal run 27A. Typically the rollers (17, 19) are co-axial or nearly co-axial with the hinge connection between adjacent horizontal panels. Thus as the multi-paneled door opens, the panels (e.g. 14, 16) articulate about the connecting hinge pins (described in more detail below). As the panels move along the track 21 and articulate relative to one another, the opposed horizontal edges also move relative to one another. The design of the panel edges and connecting hinges precludes development of a large gap between the edges regardless of the articulated position of the adjacent panels, and insertion of a test rod greater than 5mm diameter into either side (the front or back) of the door at the hinged joint is not possible because of the design.

Specifically, the opposed male and female profiles of the adjacent, horizontal edges are almost identical and over lie one another. The female profile 22, however, defines a pocket which receives the male profile 24 and eliminates gapping through a broad range of articulation. Thus the upper or female profile 22 includes a concave, generally arcuate section 26 commencing at the front face 29 of the upper panel 16. This arcuate section 26 flows into a generally flat, planar horizontal section 28 of the profile at the back side of each panel 16. The flat section 28 extends in the range of 10–25% of the thickness of the panel 16 (front to back). The flat section 28 may be eliminated if desired and the arcuate shape continued in place thereof.

Connected to or extending from the flat section 28 radially toward a hinge pin 70 with pivot axis or rotation axis 55 of the panels 16, 18 is a radial run 32 which terminates with a chord run or an underfold 30 extending toward the front of the panel 16. Run 30 is perpendicular to the front 29 and back radial run 32. The profile 22 of the female section has a linear extent or length which exceeds that of the male section profile 24 even though each profile 22, 24 is substantially identical in configuration. Male profile 24 has an arcuate section 34 which like section 26 is generally centered on axis 55. Flat section 36 underlies and is shorter than flat section 28. The arcuate sections 26, 34 are shaped and spaced with a radius of curvature centered generally on the axis 55 of hinge pin 70. This profile insures minimizing the gap between panels 16, 18 from the front side of the door in the range of 3–5 mm. as the door panels 16, 18 articulate during opening.

The backside configuration of male profile 24 of panel 18 is highly distinct from prior known constructions since the backside male profile 24 includes the radial run 40 which may parallel run 32 of panel 16 and radiates generally from the axis 55 of the hinge pin 70. However, to insure a minimum gap in the vicinity of the hinge pin 70, each radial run 32, 40 includes an underfold run or chord section 30, 38 respectively which are generally parallel and spaced slightly when the panels 16, 18 are vertical or co-planar. The spacing and length of the runs 30, 38 is derived from the pathway formed thereby as the panels 16, 18 articulate. That is, upper panel underfold run 30 traces out a profile pathway that is arcuate and maintains a minimum gap between the end of run 30 and the male lower panel run 38 as the panels articulate. The length of each run 30, 38 may thus be empirically derived to minimize the back side panel gap taking into account the spacing and length of runs 32, 40 and the location of the hinge pin axis 55.

Referring to FIG. 2A, garage door panels 16 and 18 are illustrated with the door panel 16 having a shaped bottom female portion 22 and door panel 18 having a shaped top male portion 24 in the door closed position or the fully open position. Each garage door panel 14, 16, 18, 20 includes a shaped bottom female portion 22 and a shaped top male portion 24. In use, the bottom female portion 22 of a first garage door panel 16 cooperatively relates to the top male portion 24 of a second garage door panel 18 in such a manner so as to prevent insertion of a finger into a gap between the two panels 16, 18 regardless of the relative articulation of the panels 16, 18 as they move along the side tracks as illustrated in FIG. 3 and FIG. 3A.

Thus, as illustrated in FIG. 3A, garage door panels 16 and 18 are in an articulated state and radial runs 32, 40 form an angle 44. The cross-section of the bottom female portion 22 of the garage door panel 16 is formed to include: a curvilinear segment 26, a straight horizontal segment 28 and a straight vertical segment 32. The curvilinear segment 26 connects to the front panel 29 of the garage door panel 16 and forms a rounded corner 27 between segment 26 and panel 29. The curvilinear segment 26 may form a concave arc of a circle relative to the bottom female portion 22 or may be in the form of a plurality of connected polygon sections.

The curvilinear segment 26 abuts the straight horizontal segment 28. The straight horizontal segment 28 is approximately transverse or perpendicular to the plane 29 of the door panel 16. The straight horizontal segment 28 perpendicularly connects with the straight vertical segment 32 which is approximately parallel to the plane 29 of the garage door panel 16. The straight vertical segment or run 32 forms a right angle with the straight horizontal segment or run 30 which is transverse to the plane 29 of the door panel 16. The straight horizontal segment 30 has a rounded end or tongue that may be formed by crimping the end of the straight horizontal segment 30.

Similarly, the cross-section of the male portion 24 of the garage door panel 18 includes: a curvilinear segment 34, straight horizontal segment 36, a straight vertical segment 40 and folded end 38. The curvilinear segment 34 is curved out of the plane of the garage door panel 18 and forms a transition segment 46 between the plane of the garage door panel 18 and the curvilinear segment 34. The transition segment 46 is sized and shaped to operatively mate with the rounded corner 27 of the female portion 22.

Referring back to FIG. 2A, door panels 16 and 18, in a closed position, contact each other at the point where the rounded comer 27 of door panel 16 engages the transition segment 46 of door panel 18. Along the back side, there is no gap between runs 30,40. Thus, there is no gap between panels 16 and 18 when the doors panels are in a closed position. Advantageously, no human fingers can be pinched when the door panels are in a closed (co-planar) position.

The weight of each garage door panel 14, 16, 18 is supported by a structural member. Any structural member capable of bearing the necessary load could be utilized; however, in the embodiment of FIGS. 1 through 5, substantially U-shaped channel sections 50 are used. Each U-shaped channel section 50 is fastened to the front door panel 29 by rivets 52 or other suitable fasteners, and vertically aligned with other U-shaped channel sections 50 on adjacent door panels. Moreover, each door panel includes a plurality of U-shaped channel sections 50. Thus, as depicted in FIG. 4, two U-shaped channel sections 50 are provided for each garage door panel. These U-shaped channel sections 50 are located adjacent to each end of the door panel and aligned vertically. Each U-shaped channel section 50 is preferably made of square tubing for strength and ease of assembly to each garage door panel, or is otherwise formed from flat sheet or in other ways known in the art. Each U-shape channel section 50 has a top end 51 and a bottom end 53. The top end 51 is generally shaped to match the contour of the top male portion 24 of the door panel. The top end 51 also includes spaced, parallel ribs 50A, 50B connected by a crown 50C. Two opposed, horizontally-aligned holes 54 are located through ribs 50A, 50B a the top end of each panel.

Referring to FIG. 5, a hinge leaf 60 is attached to vertically aligned U-shaped channel section 50. The hinge leaf 60 thus has a fastening portion 62 aligned with the bottom end 53 of the U-shaped channel section 50 to removably fasten the hinge leaf 60 to the U-shaped channel section 50 crown 50C. Fasteners 64 are used to removably attach the hinge leaf 60 to the U-shaped channel section 50. The fasteners 64 may be screws, rivets or any other fastening means.

The hinge leaf 60 has an angled hinge portion 66 extending from the plane of the fastening portion 62. The angled hinge portion 66 cooperates with the top end of the U-shaped channel section 50 so as to prevent human fingers from being pinched by fitting between ribs 50A and 50B. The angled hinge portion 66 forms a substantially cylindrical hole 57 horizontally extending the width of the angled hinge portion 66. The cylindrical hole 57 of the angled aligned with 66 is horizontally aligned with the two opposed horizontally-aligned holes 54 of the top end 51 of the U-shaped channel section 50.

A hinge pin 70 is located through the cylindrical hole 57 of the angled hinge portion 66 and through the two opposed horizontally-aligned holes 54. The hinge pin 70 operatively couples the U-shaped channel section 50, which is attached to door panel 18, to the angled hinge portion 66. The angled hinge portion 66 of the hinge leaf 60, in turn, couples the hinge leaf 60 to the U-shaped channel section 50 attached to door panel 16. Thus, the hinge pin 70 removably connects door panel 18 to door panel 16 and allows door panels 18 and 16 to pivot relative to one another about the hinge pin 70 as the garage door 12 transitions from a closed to an open state. As illustrated in FIG. 5, the hinge leaf 60 and hinge pin 70 are located between adjacent vertically aligned U-shaped channel ribs 50A, 50B and couple each adjacent garage door panel.

Figure 6:
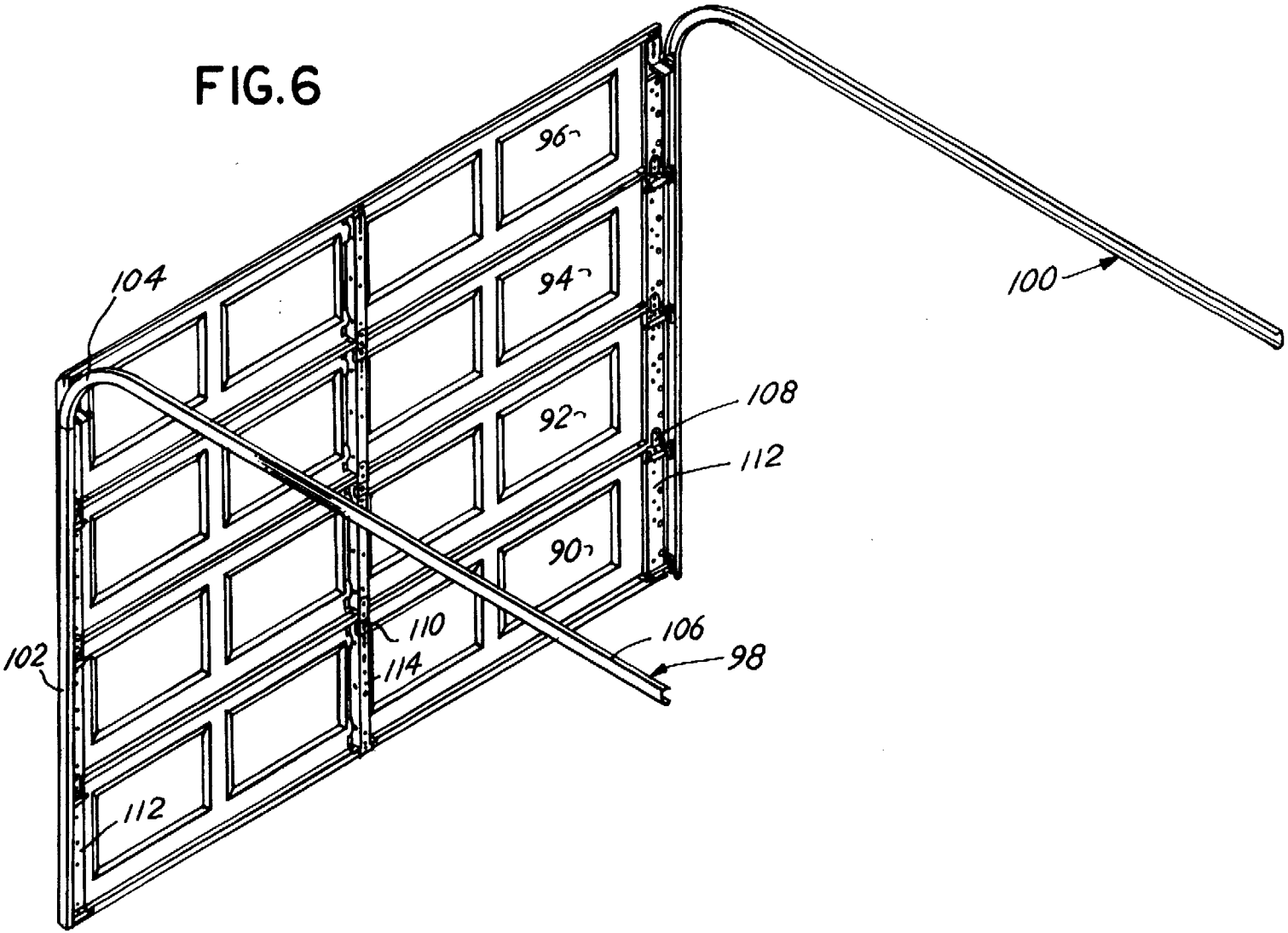
FIG. 6 is an isometric view depicting the back or inside of a second embodiment of a garage door made in accord with the invention.

FIG. 6 depicts the horizontal hinge joint construction for a garage door as incorporated into a second or alternative embodiment of the invention. The panels of FIG. 6 have a shape and configuration which is substantially identical to the shape and configuration of the panels described with respect to FIGS. 1 through 5, since the joint between the adjacent horizontal panels is identical to that previously described with respect to FIGS. 2A and 3 A. However, there are other features which are somewhat different, and in particular, the construction of the hinge which is used to attach the adjacent horizontal panels together. Whereas in the embodiment of FIGS. 1 through 5, a single hinge leaf was used in combination with the reinforcing ribs 50; in the embodiment of FIGS. 6 through 9A, the hinge element is comprised of two leaves, each of which is connected respectively to reinforcing ribs associated with adjacent, horizontal panels.

Thus, referring to FIG. 6, there is depicted a garage door comprised of four (4) horizontal panels 90, 92, 94 and 96. The panels are mounted so that they can move along a pathway defined by opposite parallel tracks 98 and 100. Each of the tracks 98 and 100 include a vertical run 102, a transition or arcuate run 104 and a generally horizontal run 106. The vertical run 102 is associated with maintaining the door in the closed configuration as depicted in FIG. 6. The arcuate run 104 is associated with the transition of the door to the open position. The horizontal run 106 is associated with the door being maintained in the fully open position. The panels 90, 92, 94, 96 are connected to one another by hinges generally depicted as hinges 108 and hinges 110. The hinges 108 are associated with the edges of the door. The hinges 110 are associated with the connection of the panels intermediate at the edges. Reinforcing ribs or channels 112 are associated with each of the panels 90, 92, 94 and 96 along their opposite edges as depicted in FIG. 6. Intermediate or central reinforcing ribs or channels 114 are also associated with and attached to each of the panels 90, 92, 94 and 96.

Figure 7:
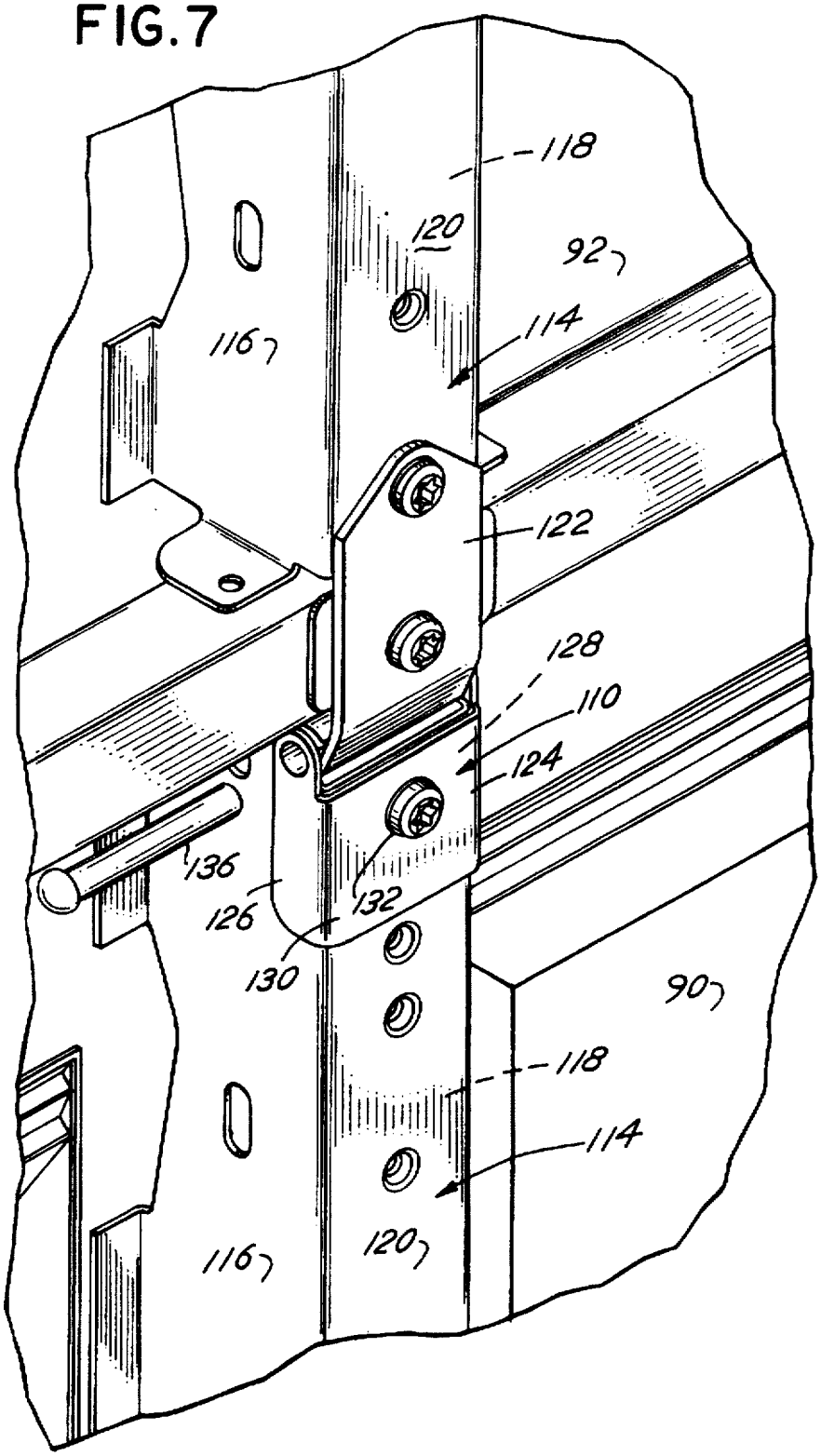
FIG. 7 is an enlarged isometric view of the hinge assembly depicted in FIG. 6 intermediate the opposite side edges of the horizontal garage door panels.

FIG. 7 depicts, in greater detail, the construction of the intermediate hinge assembly which includes hinge 110 and the aligned intermediate ribs 114 attached to adjacent panels, for example, panels 90 and 92. The intermediate channels or ribs 114 each include side rib members 116 and 118 which are parallel and are spaced one from the other. Rib members 116, 118 are connected by a crown section 120. The members 1 16 and 11 8 are attached by riveting or other means to the panels 90 and 92. The configuration of the horizontal edges of the panels 90 and 92 are, as previously stated, substantially identical to those set forth in FIGS. 2A and 3A. However, the hinges 110 are two leaf hinges. Thus an upper leaf 122 is substantially identical to the leaf 60 previously described. A lower leaf 124, however, is designed to have side flanges 126 and 128 connected by a crown section 130. The flanges 128 fit tightly over the side members 116, 118 of the intermediate rib 114, and the leaf 124 is affixed tightly to the rib 114 by means of a fastener 132. The separate leaves 122 and 124 are connected together by means of a hinge pin 136.

Figure 8:
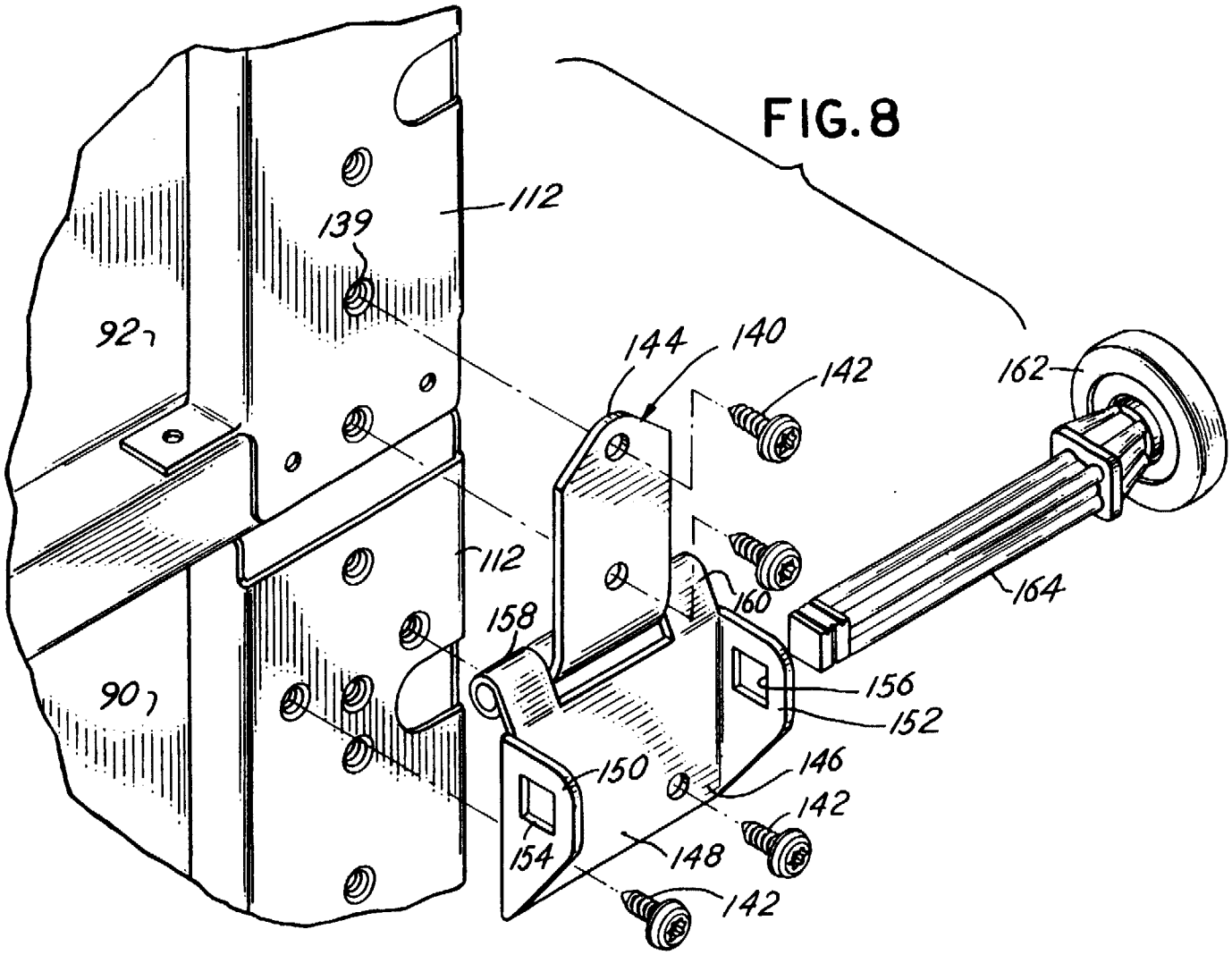
FIG. 8 is an exploded isometric view of the edge hinge assembly construction of the garage door of FIG. 6.
Figure 8A:
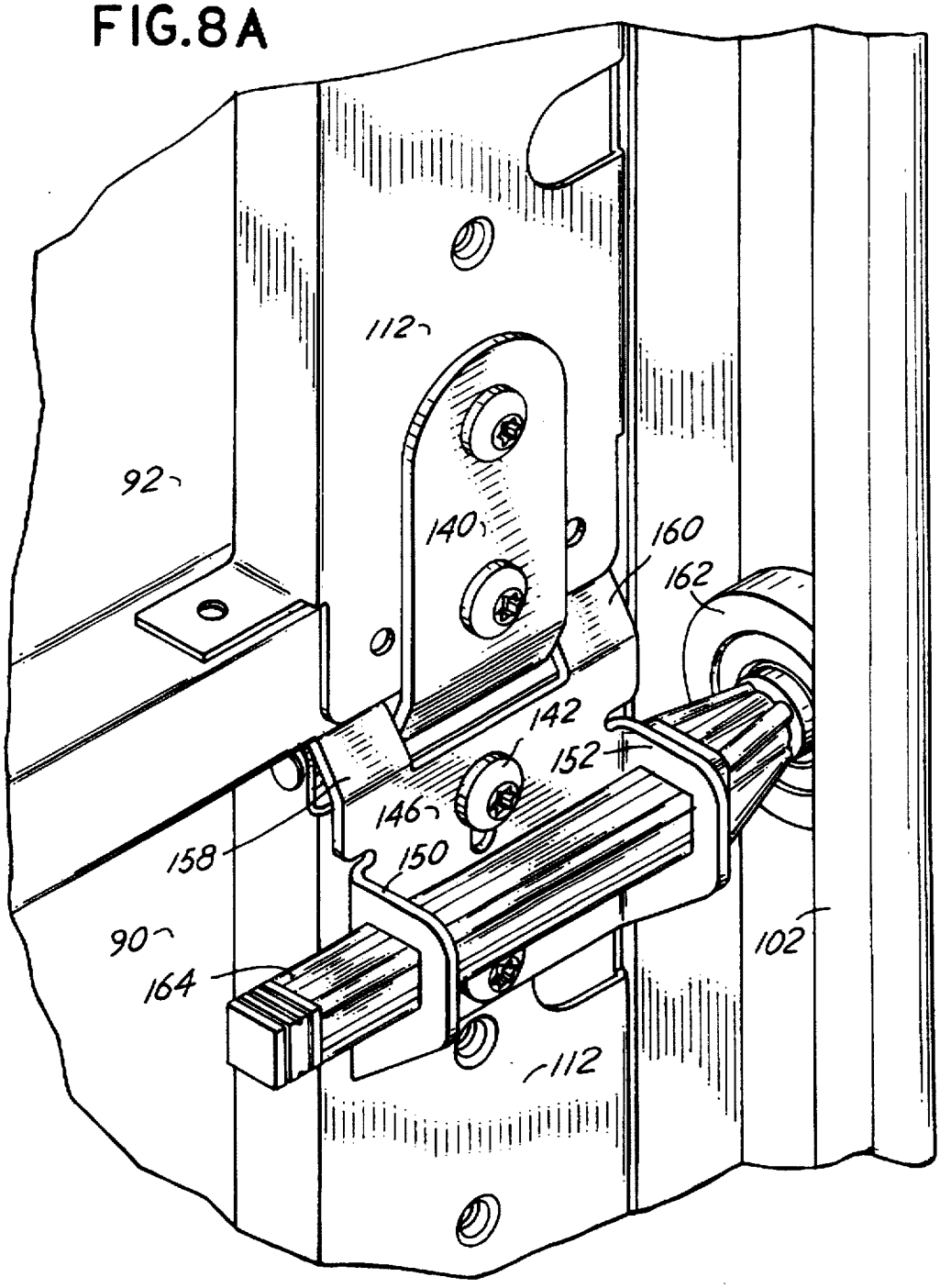
FIG. 8A is an enlarged isometric view of the edge hinge assembly construction of the embodiment depicted in FIG. 6.

Referring next to FIGS. 8 and 8A, there is depicted the construction of the edge channels or edge ribs 112 and associated hinges. The edge channels or edge ribs 112 have a construction which enables their attachment to the edge of the panels 90 and 92 and which defines a series of openings or passages 139 for a receipt of fasteners for a hinge 140. Thus, openings 139 are designed to receive fasteners 142 which attach the hinge 140 to edge channels 112 of adjacent panels 90, 92. The hinge 140 includes an upper leaf 144 having a configuration substantially like that of the central hinge leaf 122. A lower leaf 146 has a distinctive or different configuration. The leaf includes a broad central leaf member 148, upstanding outwardly extending opposed flanges 150 and 152 having keyed openings 154 and 156 defined in the flanges 150 and 152. The leaf 148 terminates with curls 158 and 160 which in combination with a hinge pin (not shown) serve to connect the leaf 148 to the leaf 140. Again, fasteners 142 are used to connect the leaf 148 to the channel or rib 112. A shaped track roller 162 is mounted on a shaped shaft or rod 164 which fits through the passages 154 and 156 and is retained thereby so that the hinge 140, in combination with the roller 162 and associated axle or rod 164, supports the door on the track 98. Note that the hinge 140 is again constructed in a fashion consistent with the previously described hinges in that the curls 158 and 160 fit into a space between the sides of the rib or channel 112 so as to avoid any pinch points.

Figure 9:
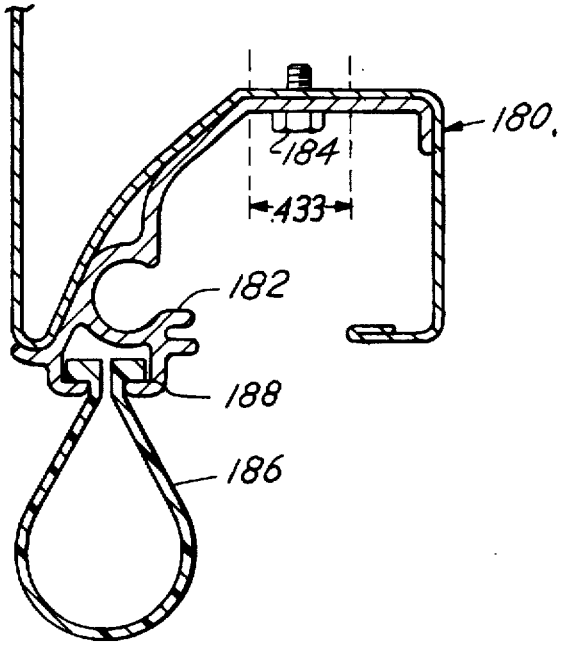
FIG.9 is a sectional view of the bottom horizontal edge of a panel of the garage door of FIG. 6.
Figure 9A:
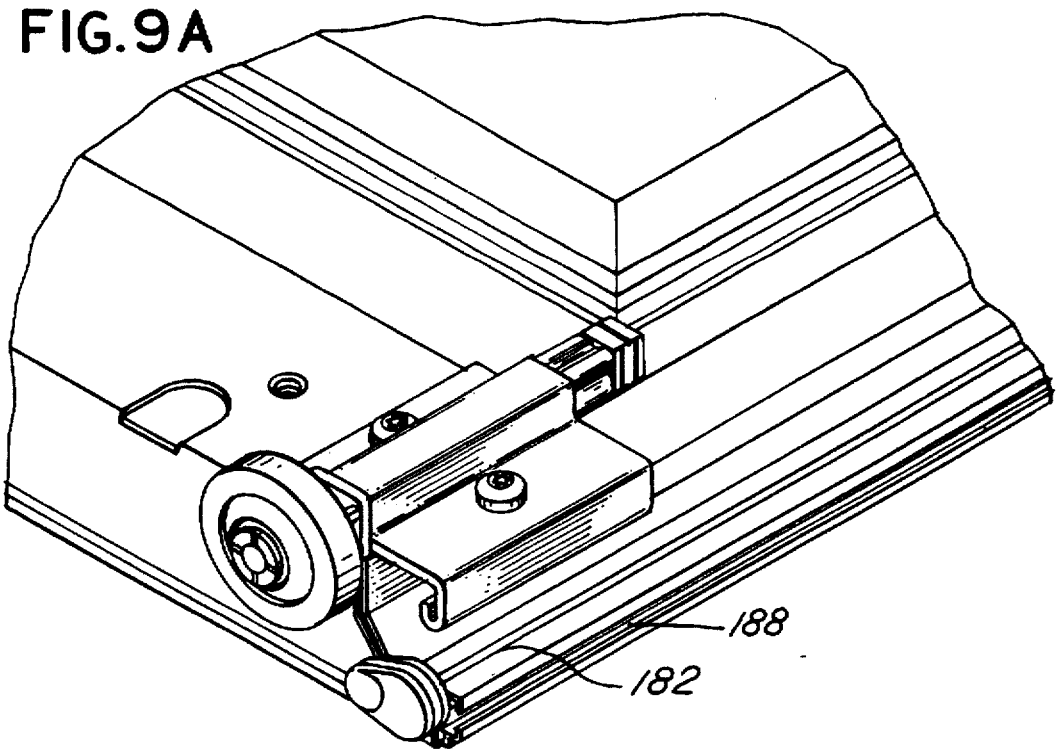
FIG. 9A is an isometric view of the bottom edge and roller of FIG. 6.

FIG. 9 illustrates the construction of a lower weather seal associated with the bottom of a horizontal panel of the garage door of FIG. 6 or FIG. I by way of example. Thus, the so called female profile 180 formed by the sheet metal skin of a garage door panel is adapted to receive a preformed aluminum extrusion 182 which has a compatible or matching shape so as to fit within the profile 180 for attachment thereto by fastening means, for example, fastening means 184. A flexible, rubber seal 186 fits within a channel 188 defined in the extrusion 182 to provide for a weather seal.

Figure 10:
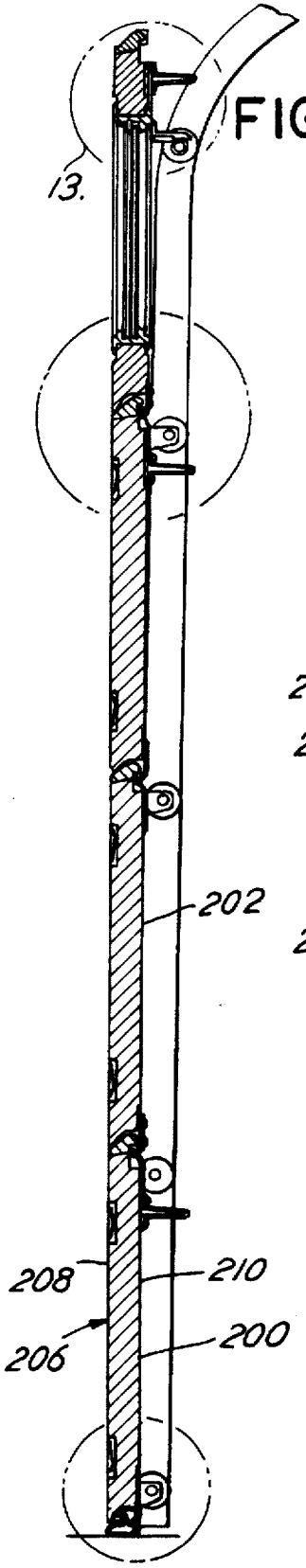
FIG. 10 is a side cross sectional view of a third embodiment of the invention as incorporated in a sandwich panel.
Figure 11:
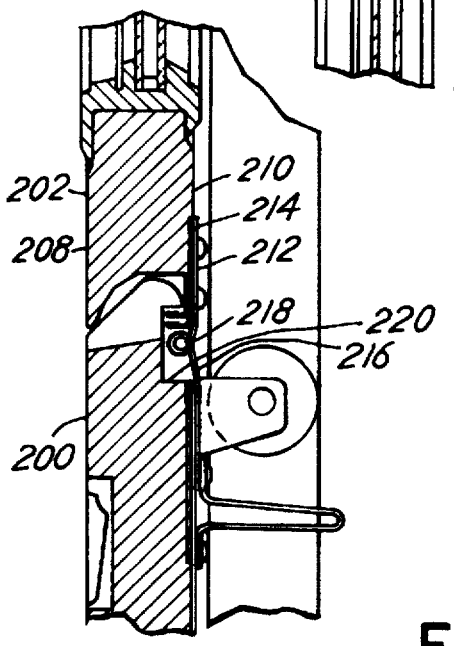
FIG. 11 is an enlarged cross sectional view of the hinge joint between adjacent panels of the door of FIG. 10.
Figure 10A:
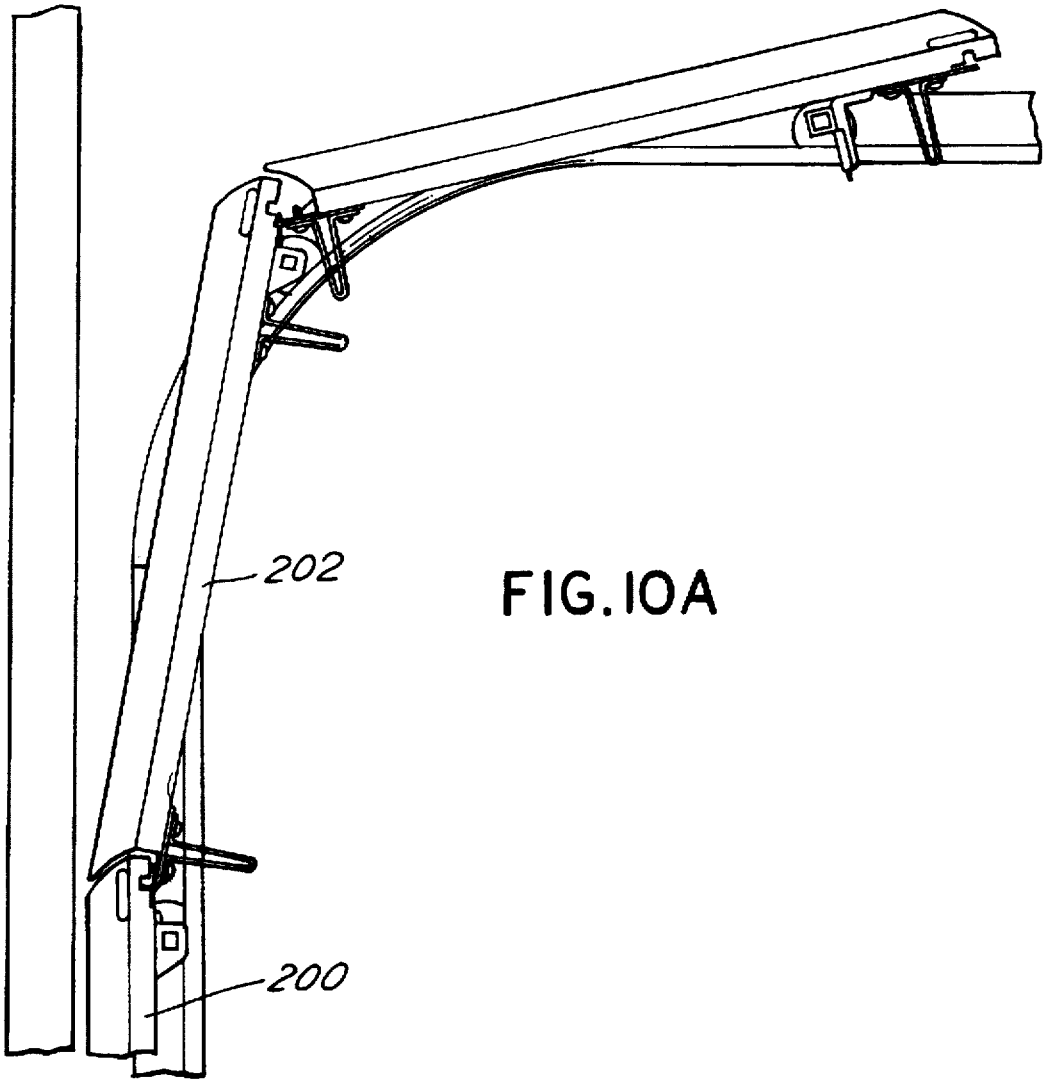
FIG. 10A is a side cross sectional view depicting in phantom the sequence of positions associated with the movement of the sandwich panel construction door of FIG. 10.
Figure 10B:
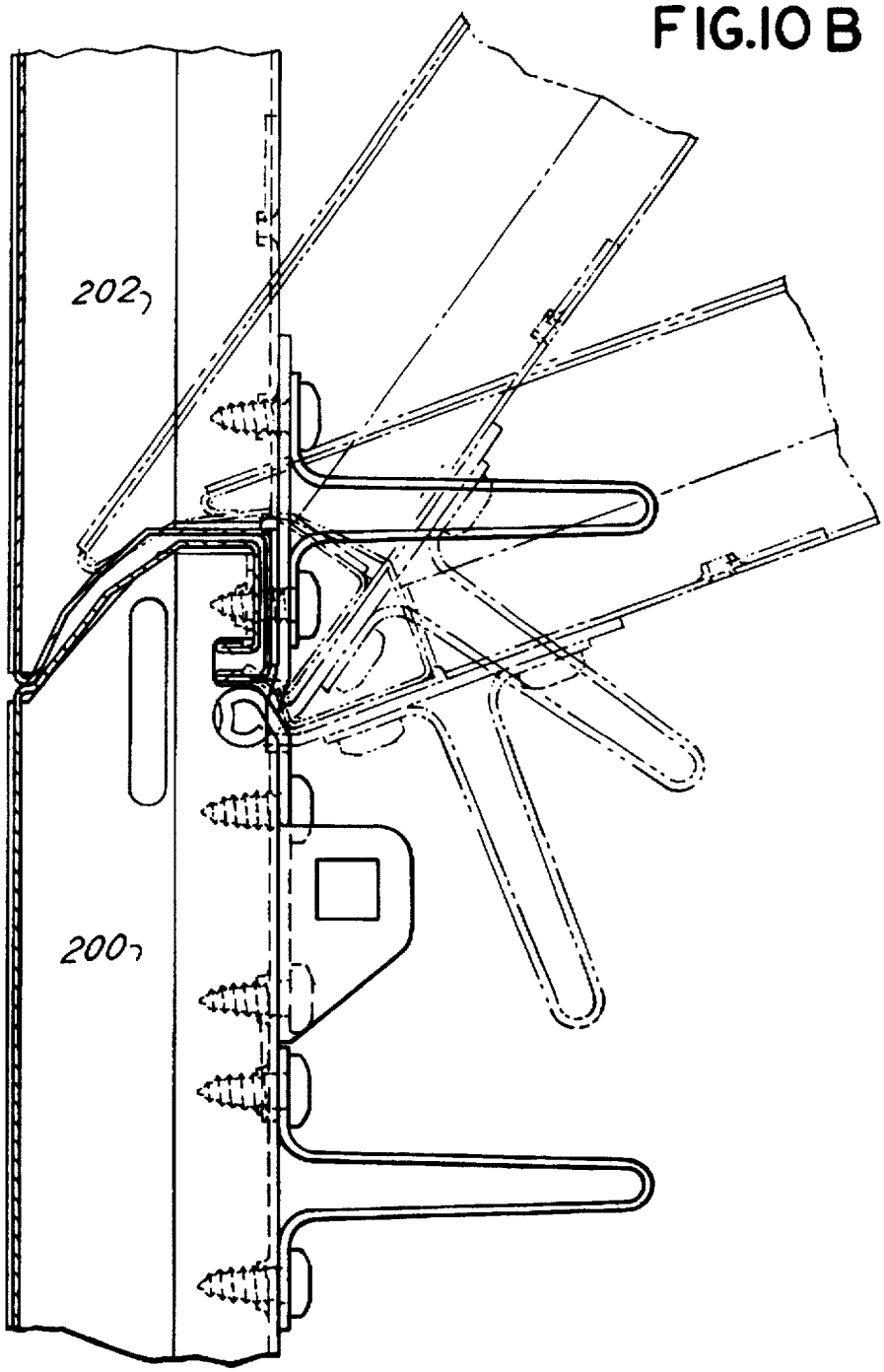
FIG. 10B is an enlarged sectional view of the hinge assembly of FIG. 10A.

FIGS. 10 through 13 depict a third embodiment of a garage door construction incorporating the invention. FIG. 10 is a side cross sectional view of the panels forming this third embodiment. The third embodiment is generically described as a sandwich panel construction. That is, referring to FIG. 10, the garage door is comprised of a series of panels 200, 202, etc. Each panel has an enclosure skin, for example, of sheet metal. Thus a skin 206 is provided to define both a front surface 208 and a back surface 210 with shaped horizontal edge surfaces. The area between the surfaces 208 and 210 is fulled typically with an expanded polystyrene material, which bonds to the interior of the skin which is defined by the sheet metal. The configuration of the horizontal joint between the panels 200 and 202, is substantially identical to that previously described, in terms of the male and female profile thereof However, in the embodiment of FIGS. 10 through 13, the hinge, rather than being connected to vertical metal ribs, is attached to the metal skin, and more particularly, to the inside surface 210 of the metal skin. Thus, as depicted in FIG. 11, a hinge is comprised of an upper leaf 212 attached to the skin or back surface 210 with the additional inclusion of a backing plate 214. A lower leaf 216 is attached to the lower panel 200, and more particularly, to the back surface skin 210 thereof. The leaves 212 and 216 are joined together by a hinge pin 218. The lower panel 200 includes a shaped or formed pocket 220 into which the hinge pin 218 and associated portions of the leaves 212 and 216 are fitted. Rollers of the type depicted in FIG. 8 cooperate with the hinge members 216 along the opposite edges of the door panels in a manner similar to that previously described. FIG. 10A depicts the articulation of adjacent panels 200, 202.

Figure 12:
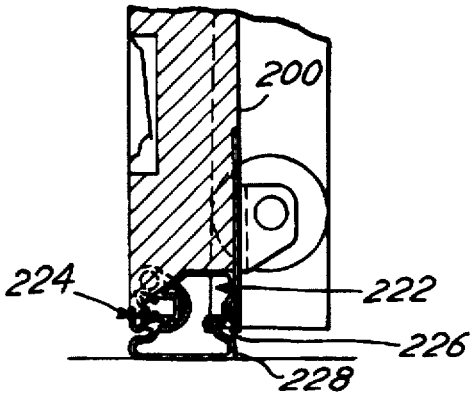
FIG. 12 is an enlarged cross sectional view of the lower edge of the lower horizontal panel of the door of FIG. 10.

Referring to FIG. 12, the weather seal associated with the bottom of the door, and more particularly, the bottom of the panel 200, is similar to that previously described. An extrusion 222 is fitted into the female profile of the panel 200. A flexible seal fits through spaced channels 224 and 226 defined in the extrusion 222 for receipt of a flexible rubber seal 228, for example.

Figure 13:
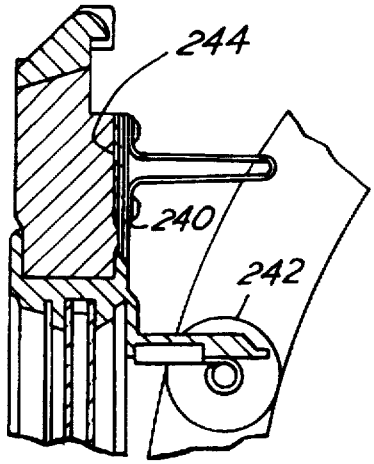
FIG. 13 is an enlarged cross sectional view of the top edge of the top panel of the door of FIG. 10.

FIG. 13 depicts the construction along the top edge of the top panel forming the door of the embodiment of FIG. 10. The male configuration associated with the top edge does not interact with any adjacent panel. A mounting plate 240 for a roller 242 is attached to the back surface 210 of the skin with a supplemental backing plate 244. The construction of FIGS. 10, 11 and 12 is associated with edges of the door. The roller attachments may be omitted with respect to hinges associated with the middle portion of such a door.

Importantly, each embodiment of the invention incorporates a unique profile along the horizontal edges of the panels. The profile can be incorporated in a door panel having merely a front metal sheet and reinforcing ribs. Alternative hinge constructions may be used with such a construction. A sandwich panel may also incorporate the shape and profile of the horizontal edges as described. In each instance, the front end of the overlying profiles is generally arcuate, whereas the back end includes an inwardly extending cord section which, when pivoted, maintains a minimum gap between an associated cord section of the inner profile or male profile of the connection between the panels. Typically, that cord section extends over the forward axis of the hinge pin.

In the foregoing specification, the present invention has been described with reference to specific exemplary embodiments thereof. It will be apparent to those skilled in the art, that a person understanding this invention may conceive of changes or other embodiments or variations, which utilize the principles of this invention without departing from the broader spirit and scope of the invention. The specification and drawings are, therefore, to be regarded in an illustrative rather than restrictive sense. Accordingly, it is not intended that the invention be limited except as may be necessary in view of the appended claims.

What is claimed is:

1. A pinch-proof garage door for protecting human fingers from being pinched, the pinch-proof garage door comprising:

a first garage door panel having a bottom female portion;

a second garage door panel having a top male portion cooperating with the bottom female portion of the first garage door panel, said bottom female portion and said top male portion shaped so as to prevent said human fingers from being pinched;

a first structural member securely fastened to said first garage door panel; a second structural member having two opposed horizontally-aligned holes, said second structural member securely fastened to said second garage door panel, said second structural member vertically aligned with said first structural member;

a hinge leaf vertically aligned with the first structural member and the second structural member, said hinge leaf having a substantially cylindrical hole aligned with the two opposed horizontally-aligned holes of the second structural member, said hinge leaf cooperating with said second structural member so as to prevent said human fingers from being pinched; and a hinge pin operatively coupling the second structural member to the hinge leaf and the first structural member, said hinge pin extending through the two opposed horizontally-aligned holes of the second structural member and the substantially cylindrical hole of the hinge leaf, whereby the first garage door panel and the second garage door panel pivot relative to one another about said hinge pin as the garage door transitions from a closed to an open state.

2. The pinch-proof garage door of claim 1 wherein the first garage door panel and the second garage door panel are horizontally oriented.

3. The pinch-proof garage door of claim 1 wherein the first structural member and the second structural member are made out of a substantially U-shaped channel section.

4. The pinch-proof garage door of claim 2 wherein the first structural member and the second structural member are made out of a substantially U-shaped channel section.

5. A pinch-proof garage door for protecting human fingers from being pinched, the pinch-proof garage door comprising:

a first horizontal panel having a bottom female portion;

a second horizontal panel having a top male portion cooperating with the bottom female portion of the first horizontal panel, said bottom female portion and said top male portion shaped so as to prevent said human fingers from being pinched;

a first U-shaped channel section securely fastened to said first horizontal panel, said first U-shaped channel section supporting at least a portion of the weight of said first horizontal panel;

a second U-shaped channel section having two opposed horizontally-aligned holes, said second U-shaped channel section securely fastened to said second horizontal panel, said second U-shaped channel section vertically aligned with said first U-shaped channel section, said second U-shaped channel section supporting at least a portion of the weight of said second horizontal panel;

a) a hinge leaf vertically aligned with the first U-shaped channel section and the second U-shaped channel section, said hinge leaf having a substantially cylindrical hole aligned with the two opposed horizontally-aligned holes of the second U-shaped channel section, said hinge leaf cooperating with said second U-shaped channel section so as to prevent said human fingers from being pinched; and b) a hinge pin operatively coupling the second U-shaped channel section to the hinge leaf and the first U-shaped channel section, said hinge pin extending through the two opposed horizontally-aligned holes of the second U-shaped channel section and the substantially cylindrical hole of the hinge leaf, whereby the first horizontal panel and the second horizontal panel pivot relative to one another about said hinge pin as the garage door transitions from a closed to an open state.

6. A pinch-proof garage door for protecting human fingers from being pinched, the pinch-proof garage door comprising:

a) a first horizontal panel having:

a first female portion located on the bottom of said first horizontal panel, said first female portion shaped so as to include:

a first female curvilinear segment, a first female horizontally disposed straight top-segment abutting said first female curvilinear segment, a first female vertically disposed straight segment perpendicularly abutting said first female horizontally disposed straight segment, a first female horizontally disposed straight bottom-segment perpendicularly abutting said first female vertically disposed straight segment, and a first male portion located on the top of said first horizontal panel, said first male portion shaped so as to include:

a first male curvilinear segment, a first male horizontally disposed straight top-segment abutting said first male curvilinear segment, a first male vertically disposed straight segment perpendicularly abutting said first male horizontally disposed straight segment, a first male horizontally disposed straight bottom-segment perpendicularly abutting said first male vertically disposed straight segment, b) a second horizontal panel having:

a second female portion located on the bottom of said second horizontal panel, said second female portion shaped so as to include:

a second female curvilinear segment, a second female horizontally disposed straight top-segment abutting said second female curvilinear segment, a second female vertically disposed straight segment perpendicularly abutting said second female horizontally disposed straight segment, a second female horizontally disposed straight bottom-segment perpendicularly abutting said second female vertically disposed straight segment, and a second male portion located on the top of said second horizontal panel, said second male portion cooperating with said first female portion of said first horizontal panel in such a manner so as to minimize a gap between the second male portion and the first female portion thereby preventing said human fingers from being pinched, said second male portion shaped so as to include:

a second male curvilinear segment, said second male curvilinear segment adjacent to said first female curvilinear segment when the garage door is in a closed position, a second male horizontally disposed straight top-segment abutting said second male curvilinear segment, said second male horizontally disposed straight top-segment adjacent to said first female horizontally disposed straight top-segment when the garage door is in said closed position, a second male vertically disposed straight segment perpendicularly abutting said second male horizontally disposed straight segment, said second male vertically disposed straight segment adjacent to said first female vertically disposed straight segment when the garage door is in said closed position, and a second male horizontally disposed straight bottom-segment perpendicularly abutting said second male vertically disposed straight segment, said second male horizontally disposed straight bottom-segment adjacent to said first male horizontally disposed straight bottom-segment when the garage door is in said closed position;

c) a first U-shaped channel section securely fastened to said first horizontal panel, said first U-shaped channel section supporting most of the weight of said first horizontal panel;

d) a second U-shaped channel section having two opposed horizontally-aligned holes, said second U-shaped channel section securely fastened to said second horizontal panel, said second U-shaped channel section vertically aligned with said first U-shaped channel section, said second U-shaped channel section supporting most of the weight of said second horizontal panel, e) a hinge leaf having:

a straight portion vertically aligned with the first U-shaped channel section and the second U-shaped channel section, said straight portion securely fastened to said first U-shaped channel section, an angled portion abutting said straight portion, said angled portion having a substantially cylindrical hole horizontally extending the width of the angled portion, said substantially cylindrical hole horizontally-aligned with the two opposed horizontally-aligned holes of the second U-shaped channel section, said angled portion of said hinge leaf cooperating with said second U-shaped channel section so as to prevent said human fingers from being pinched; and f) a hinge pin operatively coupling the second U-shaped channel section to the hinge leaf and the first U-shaped channel section, said hinge pin extending through the two opposed horizontally-aligned holes of the second U-shaped channel section and the substantially cylindrical hole of the hinge leaf, whereby the first horizontal panel and the second horizontal panel pivot relative to one another about said hinge pin as the garage door transitions from a closed to an open state.

7. A pinch-proof garage door for protecting human fingers from being pinched, the pinch-proof garage door comprising:

a) a first horizontal panel having:

a first female portion located on the bottom of said first horizontal panel, said first female portion shaped so as to include:

a first female curvilinear segment, a first female horizontally disposed straight top-segment abutting said first female curvilinear segment, a first female vertically disposed straight segment perpendicularly abutting said first female horizontally disposed straight segment, a first female horizontally disposed straight bottom-segment perpendicularly abutting said first female vertically disposed straight segment, and b) a second horizontal panel having:

a first male portion located on the top of said first horizontal panel, said first male portion shaped so as to include:

a first male curvilinear segment, a first male horizontally disposed straight top-segment abutting said first male curvilinear segment, a first male vertically disposed straight segment perpendicularly abutting said first male horizontally disposed straight segment, a first male horizontally disposed straight bottom-segment perpendicularly abutting said first male vertically disposed straight segment, said first male portion cooperating with said first female portion of said first horizontal panel in such a manner so as to minimize a gap between the male portion and the first female portion thereby preventing said human fingers from being pinched, said male portion shaped so as to have generally the same profile as the first female portion, and enclosed therein when the panels abut in a planar manner;

a hinge connecting the panels having a horizontal pivot axis adjacent the intersection of the vertically disposed straight segments of the male and female portions and the attached horizontal segments extending therefrom toward the front of each panel.

* * * * *

UNITED STATES PATENT AND TRADEMARK OFFICE

CERTIFICATE OF CORRECTION

PATENT NO. : 5,782,283

DATED : July 21, 1998

INVENTOR(S) : Kendall

It is certified that error appears in the above-identified patent and that said Letters Patent is hereby corrected as shown below:

Col. 8, ln. 3 reads "-ber line 1 16 and 1 18" and should read --member line 116 and 118--

Signed and Sealed this

Ninth Day of February, 1999

*Attest:*

*Acting Commissioner of Patents and Trademarks*

*Attesting Officer*